US008507168B2

(12) United States Patent
Hiraoka et al.

(10) Patent No.: US 8,507,168 B2
(45) Date of Patent: Aug. 13, 2013

(54) ELECTROSTATIC IMAGE-DEVELOPING TONER, ELECTROSTATIC IMAGE DEVELOPER, TONER CARTRIDGE, PROCESS CARTRIDGE, AND IMAGE FORMING APPARATUS

(75) Inventors: Satoshi Hiraoka, Kanagawa (JP); Sumiaki Yamasaki, Kanagawa (JP); Susumu Yoshino, Kanagawa (JP); Shigeru Seitoku, Kanagawa (JP); Hirofumi Shiozaki, Kanagawa (JP); Kazuhiko Yanagida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 240 days.

(21) Appl. No.: 13/032,083

(22) Filed: Feb. 22, 2011

(65) Prior Publication Data

US 2012/0040284 A1 Feb. 16, 2012

(30) Foreign Application Priority Data

Aug. 13, 2010 (JP) ..... 2010-181434

(51) Int. Cl.
*G03G 9/08* (2006.01)

(52) U.S. Cl.
USPC ..... 430/109.3; 399/252

(58) Field of Classification Search
USPC ..... 430/109.3; 399/252
See application file for complete search history.

(56) References Cited

U.S. PATENT DOCUMENTS

| | | | | |
|---|---|---|---|---|
| 5,753,397 | A * | 5/1998 | Nakayama | 430/108.4 |
| 5,827,633 | A * | 10/1998 | Ong et al. | 430/137.14 |
| 5,858,598 | A | 1/1999 | Nakayama | |
| 5,902,710 | A | 5/1999 | Ong et al. | |
| 7,759,036 | B2 | 7/2010 | Utsumi et al. | |

FOREIGN PATENT DOCUMENTS

| | | |
|---|---|---|
| JP | B2-4-75500 | 12/1992 |
| JP | A-2000-98664 | 4/2000 |
| JP | A-2000-162818 | 6/2000 |
| JP | A-2008-15138 | 1/2008 |

* cited by examiner

*Primary Examiner* — Mark A Chapman
(74) *Attorney, Agent, or Firm* — Oliff & Berridge, PLC

(57) ABSTRACT

An electrostatic image developing toner that includes a toner particle including a binder resin containing a resin selected from an acrylic resin, a styrene-acrylic resin, and a styrene-(meth)acrylic acid ester copolymer. The resin has a crosslinked structure formed by using at least one of boric acid and boric acid derivatives.

13 Claims, 2 Drawing Sheets

ELECTROSTATIC IMAGE-DEVELOPING TONER, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-181434 filed Aug. 13, 2010.

BACKGROUND

(i) Technical Field

The present invention relates to an electrostatic image-developing toner, an electrostatic image developer, a toner cartridge, a process cartridge, and an image forming apparatus.

SUMMARY

According to an aspect of the invention, there is provided an electrostatic image developing toner that includes a toner particle including a binder resin containing a resin selected from an acrylic resin, a styrene-acrylic resin, and a styrene-(meth)acrylic acid ester copolymer. The resin has a crosslinked structure formed by using at least one of boric acid and boric acid derivatives.

BRIEF DESCRIPTION OF THE DRAWINGS

Exemplary embodiments of the present invention will be described in detail based on the following figures, wherein.

DETAILED DESCRIPTION

Figure 1:
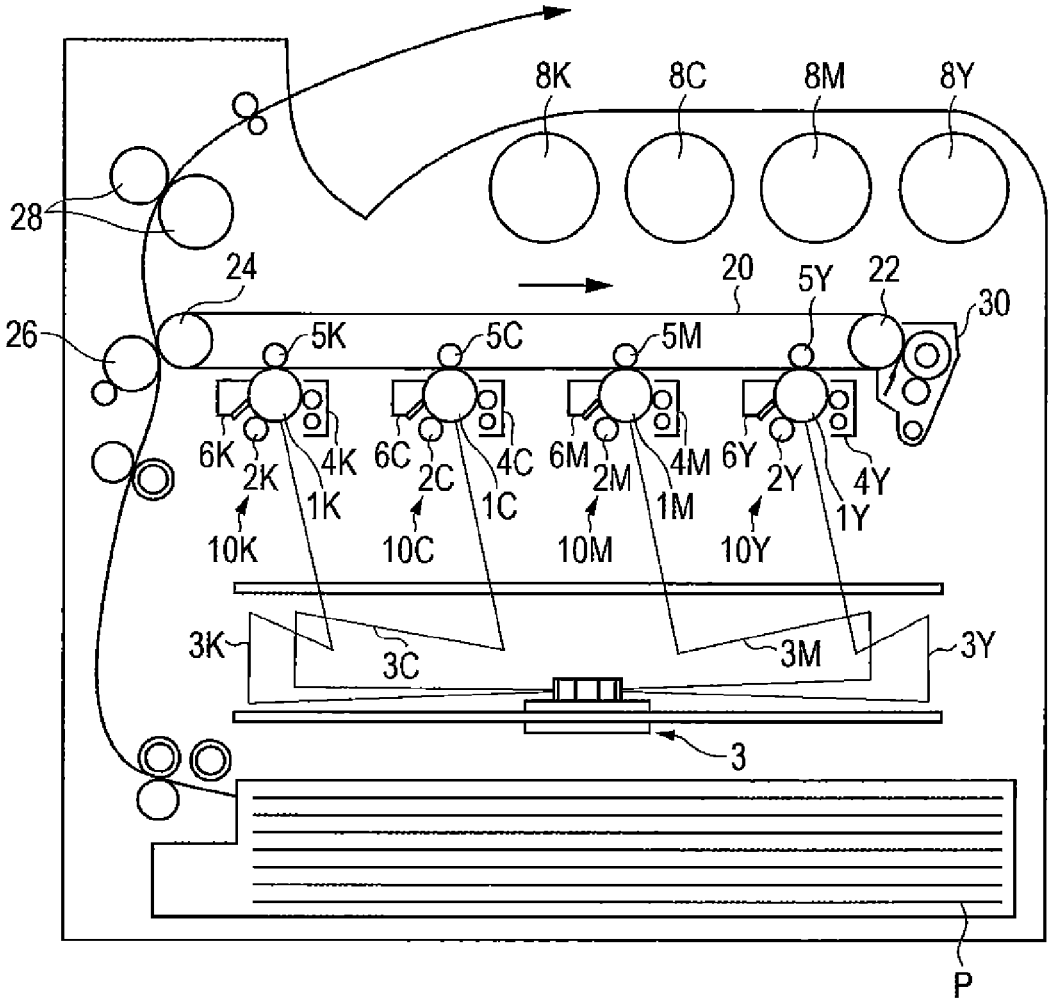
FIG. 1 is a schematic diagram showing an example of an image forming apparatus according to an exemplary embodiment.

Exemplary embodiments of an electrostatic image-developing toner, an electrostatic image developer, a toner cartridge, a process cartridge, and an image forming apparatus will now be described in detail.

[Electrostatic Image Developing Toner]

An electrostatic image developing toner of the exemplary embodiment (also referred to as "toner" hereinafter) includes a toner particle containing a resin (also referred to as "boron crosslinked resin" hereinafter) having a crosslinked structure derived from at least one of boric acid and boric acid derivatives (also referred to as "boric acid or the like" hereinafter).

The boron crosslinked resin is a resin having a crosslinked structure (structure in which two or more functional groups in a polymer compound are bonded to each other through boron atoms) resulting from reactions between boric acid or the like and two or more functional groups (groups reactive to boric acid or the like) contained in a polymer compound. To be more specific, in the case where boric acid is reacted with two OH groups (group reactive to boric acid or the like) in a polymer compound, a crosslinked structure having a —O—B—O— structure is formed as a result of dehydration reaction, and the —O—B—O— structure may be regarded as functioning as a link that bonds the two OH groups to each other. In other words, in a boron crosslinked resin, the boron atoms contribute to formation of the crosslinked structure. Hereinafter, the crosslinked structure formed by contribution of a boron atom may be referred to as "boron crosslinked structure".

The two or more functional groups (groups reactive to boric acid or the like) in the polymer compound may be contained in one molecule or two or more different molecules. In other words, two or more sites in one molecule of the polymer compound may be linked with each other through a boron atom, or different molecules of the polymer compound may be linked with each other through a boron atom.

Since the toner particles in the toner of the exemplary embodiment contain a boron crosslinked resin, the decrease in transfer efficiency is suppressed. Although the exact reason therefor is not clear, the following may be presumed. That is, the toner of the exemplary embodiment exhibits higher hardness presumably due to incorporation of the boron crosslinked resin than when the resin contained in the toner particles does not have a crosslinked structure. When the toner is being stirred in a developing device, for example, pressure applied to the toner particles may render the external additive to become buried from the surface of the toner particles or may deform the toner particles. Such deterioration of the toner particles may be suppressed due to high hardness of the toner particles and thus the decrease in transfer efficiency resulting from such deterioration of the toner particles may be suppressed.

In this exemplary embodiment, since deterioration of the toner particles is suppressed, the decrease in charging performance of the toner particles is also suppressed.

The toner of the exemplary embodiment including the toner particles containing a boron crosslinked resin has a low minimum fixing temperature and good fixability compared to a toner that contains a crosslinked resin other than boron crosslinked resins. The reason therefor is not clear but is probably the dissociation of the boron crosslinked structure caused by heat (temperature of 100° C. to 160° C., for example) applied to the boron crosslinked resin during fixing. Compared to when a crosslinked resin other than the boron crosslinked resin is used, presumably, the hardness of the resin at the fixing temperature is low and thus the minimum fixing temperature is low. When the boron crosslinked resin is cooled (e.g., cooled to a temperature of 80° C. or lower) after being heated to the fixing temperature, the dissociated crosslinked structure is recombined. Thus, the strength of the fixed image is increased and the fixability is improved.

The material, process conditions, and evaluation and analytic conditions employed in the exemplary embodiment will now be described in detail.

The toner of the exemplary embodiment includes toner particles and any other adequate external additives.

First, the toner particles are described.

<Toner Particles>

The toner particles containing a boron crosslinked resin may additionally contain other components such as another resin, a colorant, a releasing agent, a charge control agent, and inorganic oxide particles. The boron crosslinked resin is a resin having a crosslinked structure resulting from the reaction between boric acid or the like and two or more functional groups (groups reactive to the boric acid or the like) contained in a polymer compound, as described above.

—Boric Acid and Boric Acid Derivatives—

Examples of the boric acid and boric acid derivatives include unsubstituted boric acid and boric acid derivatives such as organic boric acid, boric acid salts, and boric acid esters.

Examples of the organic boric acids include n-butyl boric acid, 2-methylpropyl boric acid, phenyl boric acid, o-tolyl boric acid, p-tolyl boric acid, and 4-methoxyphenyl boric acid.

Examples of the boric acid salts include inorganic boric acid salts and organic boric acid salts, e.g., sodium tetraborate and ammonium borate.

Examples of the boric acid esters include trimethyl borate, triethyl borate, tri-n-propyl borate, tri-i-propyl borate, tri-n-butyl borate, tri-tert-butyl borate, triphenyl borate, di-i-propyl butyl borate, trihexyl borate, tri(2-ethylhexyl)borate, trioctadecyl borate, tritetradecyl borate, and triphenyl borate. The boric acid esters may have a cyclic structure. Examples of the cyclic boric acid esters include 2,4,6-trimethoxyboroxin and 2,4,6-trimethylboroxin. These compounds may be anhydrous or hydrated but are preferably anhydrous. Among the boric acid and its derivatives, boric acid, trimethyl borate, triethyl borate, tri-i-propyl borate, tri-n-butyl borate, and tri(2-ethylhexyl)borate are preferred.

—Polymer Compound Having Groups Reactive to Boric Acid or the Like—

Examples of the polymer compound that forms a boron crosslinked resin when reacted with boric acid or the like include polymer compounds having groups reactive to boric acid or the like (may be referred to as "boric acid-reactive group" hereinafter). An example of the boric acid-reactive group is an OH group. Examples of the polymer compound having the boric acid-reactive group include polymer compounds that contain constitutional units derived from the monomers having the boric acid-reactive group. The polymer compound may contain constitutional units derived from other monomers in addition to the constitutional unit derived from the monomer having the boric acid-reactive group. In other words, the polymer compound may be a homopolymer made from a monomer having a boric acid-reactive group or a copolymer of the monomer having the boric acid-reactive group and another monomer.

The polymer compound having the boric acid-reactive group may be obtained by polymerizing a monomer having the boric acid-reactive group, copolymerizing the monomer having the boric acid-reactive group and another monomer, introducing a boric acid-reactive group into a polymer compound having no boric acid-reactive group, or introducing another boric acid-reactive group into the polymer compound having a boric acid-reactive group.

When the boric acid-reactive group is a OH group, the OH group may be introduced into the polymer compound by addition reaction, hydrolysis reaction, copolymerization reaction, or the like. A specific example of the addition reaction is a method of reacting a hydroxyl-containing compound with a halogenated (meth)acryloyl in the presence of a tertiary amine. Specific examples of the hydrolysis reaction include a method of conducting hydrolysis after copolymerizing vinyl acetate monomers, a method of conducting hydrolysis after copolymerizing silanol-containing monomers (e.g., 3-methacryloxypropyltriethoxysilane), and a method of conducting hydrolysis by bringing substituents (e.g., an ester group, an alkoxy group, a carboxyl group, a carbonyl group, a halogen group, a nitrile group, or a nitro group) in contact with high-temperature, high-pressure water. An example of the copolymerization method includes copolymerizing (meth)acrylic acid ester (e.g., 2-hydroxyethyl (meth)acrylate) having a hydroxyl group.

When the polymer compound having the boric acid-reactive group is a copolymer of a monomer having a boric acid-reactive group and another monomer, the ratio of the constitutional units derived from the monomer having the boric acid-reactive group to all constitutional units derived from the monomer having the boric acid-reactive group and the other monomer is, for example, 5 mass % to 70 mass % or about 5 mass % to about 70 mass % and may be 10 mass % to 30 mass % or about 10 mass % to about 30 mass %.

The polymer compound may be of any type as long as the boric acid-reactive group is contained. Examples thereof include acrylic resins such as (meth)acrylic resin, styrene-(meth)acryl copolymers, and styrene-alkyl (meth)acrylate copolymers. The phrase "(meth)acryl" includes both "acryl" and "methacryl" and is used in this sense in the description below.

Acrylic resins having OH groups will now be described as an example of the polymer compound.

Examples of the monomer including an OH group include 2-hydroxyethyl (meth)acrylate, 2-hydroxypropyl (meth) acrylate, 2-hydroxypentyl (meth)acrylate, phenoxyhydroxypropyl (meth)acrylate, hydroxyphenyl (meth)acrylate, hydroxybenzyl (meth)acrylate, glycerol (meth)acrylate, dihydroxyphenethyl (meth)acrylate, trimethylolpropane mono(meth)acrylate, pentaerythritol mono(meth)acrylate, 2-(hydroxyphenylcarbonyloxy)ethyl (meth)acrylate, caprolactone-modified 2-hydroxyethyl (meth)acrylate, polyethylene glycol mono(meth)acrylate, and polypropylene glycol mono(meth)acrylate. Among these, glycerol acrylate, glycerol methacrylate, 2-hydroxyethyl acrylate, 2-hydroxyethyl methacrylate, 2-hydroxypropyl acrylate, and 2-hydroxypropyl methacrylate are particularly preferable.

Examples of the other monomer include (meth)acrylic acid esters, (meth)acrylamides, vinyl esters, styrenes, (meth) acrylic acids, (meth)acrylonitrile, maleic anhydrides, and maleic acid imides.

Examples of the (meth)acrylic acid esters include methyl (meth)acrylate, ethyl (meth)acrylate, (n-, i-, sec-, or tert-) butyl (meth)acrylate, amyl (meth)acrylate, 2-ethylhexyl (meth)acrylate, dodecyl (meth)acrylate, stearyl (meth)acrylate, chloroethyl (meth)acrylate, cyclohexyl (meth)acrylate, isobornyl (meth)acrylate, dicyclopentanyl (meth)acrylate, allyl (meth)acrylate, benzyl (meth)acrylate, methoxybenzyl (meth)acrylate, chlorobenzyl (meth)acrylate, furfuryl (meth) acrylate, tetrahydrofurfuryl (meth)acrylate, phenyl (meth) acrylate, chlorophenyl (meth)acrylate, and sulfamoylphenyl (meth)acrylate.

Examples of the (meth)acrylamides include (meth)acrylamide, N-methyl (meth) acrylamide, N-ethyl (meth) acrylamide, N-propyl (meth) acrylamide, N-butyl (meth)acrylamide, N-benzyl (meth)acrylamide, N-phenyl (meth) acrylamide, N-tolyl (meth)acrylamide, N-(sulfamoylphenyl) (meth)acrylamide, N-(phenylsulfonyl) (meth)acrylamide, N-(tolylsulfonyl) (meth)acrylamide, N,N-dimethyl (meth) acrylamide, and N-methyl-N-phenyl (meth) acrylamide.

Examples of the vinyl esters include vinyl acetate, vinyl butyrate, and vinyl benzoate.

Examples of the styrenes include styrene, methylstyrene, dimethylstyrene, tirmethylstyrene, ethylstyrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene, and carboxystyrene.

—Method for Making Boron Crosslinked Resin—

Examples of the method for forming a boron crosslinked resin by reacting boric acid or the like with a polymer compound having a boric acid-reactive group include a method for heating and melting the polymer compound having the boric acid-reactive group and a method of using a solvent to conduct dissolution.

The method of heating and melting the polymer compound includes, for example, mixing boric acid or the like with a polymer compound having the boric acid-reactive group, and heating the resulting mixture to melt the polymer compound and conduct kneading. The temperature of the heating may be, for example, 120° C. to 200° C. The heating time may be, for example, 0.5 to 3 hours.

The method of using a solvent may include, for example, dissolving a polymer compound having a boric acid-reactive group in a solvent and adding boric acid or the like to the resulting solution.

The solvent may be any as long as it dissolves the polymer compound having a boric acid-reactive group. Examples thereof include solvents that do not modify the polymer compound having a boric acid-reactive group, such as methyl ethyl ketone, acetone, and tetrahydrofuran. The amount of the solvent may be, for example, in the range of 0.5 g to 100 g relative to 1 g of the polymer compound having a boric acid-reactive group. The temperature of the solvent when dissolving the polymer compound having a boric acid-reactive group may be, for example, 10° C. to a temperature 20° C. lower than the boiling temperature of the solvent.

The mass of boric acid or the like added to 1 g of the polymer compound having a boric acid-reactive group is, for example, in the range of 0.3 to 5 g or about 0.3 to about 5 g may be in the range of 0.5 to 2 g.

The amount of the boric acid or the like added to 1 mol of the boric acid-reactive group of the polymer compound is, for example, 0.1 to 1 mol and may be 0.3 to 0.7 mol.

—Method of Confirming Boron Crosslinked Structure—

Whether the resin prepared as described above is a boron crosslinked resin (whether boron atoms contribute to formation of the crosslinked structure) may be confirmed by, for example, using the boron crosslinked structure's tendency to dissociate with an acid as described below.

For example, a weighed sample (boron crosslinked resin) is placed in an Erlenmeyer flask, 20 ml of a special grade toluene at room temperature (25° C.) is poured into the flask, and the mixture is stirred for four hours at room temperature (25° C.) and kept in a refrigerator (0° C.) overnight (12 hours). The mixture is then placed in a centrifuge tube of a centrifugal separator and centrifugally separated for 20 minutes at a speed of 12,000 turns per hour. The centrifuge tube after centrifugal separation is left standing at room temperature (25° C.) for 1.5 hours. Then the lid of the centrifugal tube is opened and the supernatant is taken out with a micropipette.

Then insoluble precipitates are dried with a drier to obtain a gel component.

To an acid, i.e., an acidic solution containing 10 ml of water and 1 ml of 0.3 mol/L nitric acid, 1 g of the gel component is added, followed by stirring for 1 hour at room temperature (25° C.), and the gel component is separated by filtration or the like and dried at a room temperature.

After this acid treatment, 20 ml of a special grade toluene at room temperature (25° C.) is poured into the flask, and the mixture is stirred for four hours at room temperature (25° C.) and kept in a refrigerator (0° C.) overnight (12 hours). The mixture is then placed in a centrifuge tube of a centrifugal separator and centrifugally separated for 20 minutes at a speed of 12,000 turns per hour. The centrifuge tube after centrifugal separation is left standing at room temperature (25° C.) for 1.5 hours. The lid of the centrifugal tube is opened, and 2.5 ml of supernatant is taken with a micropipette and placed in an aluminum dish separately weighed. The toluene component is evaporated by using a hot plate. The aluminum dish is vacuum-dried for 8 hours. The weight of the aluminum dish after vacuum drying is measured and the content of the gel component having the boron crosslinked structure is calculated by the following equation.

$$\text{Content of gel having boron crosslinked structure } (\%) = \{(B' - C') \times 8\}/A' \times 100$$

A': mass of sample [g]

B': total mass of toluene solubles and aluminum dish [g]

C': mass of aluminum dish only [g]

Whether the toner contains a boron crosslinked resin is determined by using the toner as a sample and confirming the presence of a gel component having a boron crosslinked structure by the aforementioned method (method of using the boron crosslinked structure's tendency to dissociate with an acid).

Whether the obtained resin is a boron crosslinked resin (or whether the toner contains a boron crosslinked resin) may be confirmed by boron nuclear magnetic resonance (NMR) instead of the aforementioned method. In boron NMR, a solution of a resin in a deuterochloroform is placed in a NMR tube to conductor measurement. When the crosslink is a boron crosslink, the carbon atom adjacent to a boric ester exhibits a chemical shift of 0.2 to 0.4 ppm from when the sample resin is dissociated. This may be determined by measuring the crosslinked resin and the resin with dissociated crosslinks resulting from the acid treatment.

Whether the obtained resin is boron-crosslinked or not may be confirmed by taking an infrared absorption spectrum. To be more specific, KBr with an adequate amount of a sample resin mixed therein is molded to form a sample. Then an infrared absorption spectrum is taken from this sample. In an infrared absorption spectrum of alkyl borate, the vibration of the boric acid has an absorption wavelength at 1380 $cm^{-1}$ and the absorption wavelength shifts to 1310 $cm^{-1}$ once a crosslink is formed. This helps determine whether the resin is crosslinked or dissociated.

The temperature at which the boron crosslinked structure obtained as above undergoes dissociation is, for example, in the range of 100° C. to 160° C.

—Another Resin—

The toner particles containing the boron crosslinked resin as a binder resin may further contain another resin in the binder resin, if needed.

Examples of the other resin include homopolymers and copolymers, e.g., monoolefins such as ethylene, propylene, butylene, and isoprene; vinyl esters such as vinyl acetate, vinyl propionate, vinyl benzoate, and vinyl butyrate; α-methylene fatty monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Representative examples of the binder resin among these include polystyrene, styrene-alkyl acrylate copolymer, styrene-butadiene copolymer, styrene-maleic anhydride copolymer, and polypropylene. Other examples of the binder resin include polyesters, polyurethanes, epoxy resins, silicone resins, polyamides, and modified rosins.

When the toner particle contains another resin, the ratio of the boron crosslinked resin to the total of the boron crosslinked resin and another resin is, for example, 5 to 90 mass % and may be 10 to 70 mass % or about 10 to about 70 mass %.

—Colorant—

The colorant is not particularly limited. Examples thereof include carbon black, aniline blue, Calco Oil blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. T. Pigment Red 57:1, C. I. Pigment Yellow 97, C. I. Pigment Yellow 12, C. I. Pigment Blue 15:1, and C. I. Pigment Blue 15:3.

—Releasing Agent—

Examples of the releasing agent include paraffin wax and derivatives thereof, montan wax and derivatives thereof, microcrystalline wax and derivatives thereof, Fischer-Tropsch wax and derivatives thereof, and polyolefin wax and derivatives thereof. The "derivatives" include oxides, polymers with vinyl monomers, and graft-modified compounds. Other examples of the releasing agent include alcohols, fatty acids, vegetable wax, animal wax, mineral wax, ester wax, and acid amides.

—Charge Control Agent—

The toner particles may contain a charge control agent if needed. When the toner particles are used in a color toner, a colorless or light-colored charge control agent that does not affect the color tone may be used. A known charge control agent may be used. Examples thereof include azo-based metal complexes and metal complexes and metal salts of salicylic acid or alkyl salicylic acid.

—Inorganic Oxide Particles—

The toner particles may contain inorganic oxide particles inside. Examples of the inorganic oxide particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$. Of these, silica particles and titania particles are particularly preferable as the inorganic oxide particles. The surfaces of the inorganic oxide particles may or may not be hydrophobized in advance. Hydrophobing the inorganic oxide particles suppresses the environmental dependency of charging and carrier contamination even when the inorganic oxide particles in the toner particle are exposed in the toner surface.

The inorganic oxide particles are hydrophobized by dipping inorganic oxide particles in a hydrophobing agent, for example.

The hydrophobing agent is not particularly limited. Examples thereof include silane coupling agents, silicone oil, titanate coupling agents, and aluminum coupling agents. These may be used alone or in combination. Among these, silane coupling agents are preferred. Examples of the silane coupling agents include chlorosilane, alkoxysilane, silazane, and special silylation reagent. Examples of the silane coupling agent are the same as the examples of the surface-treating agent for the inorganic oxide particles used as an external additive described below.

The amount of the hydrophobing agent differs depending on the type of the inorganic oxide particles and is not defined. For example, 5 to 50 parts by mass of the hydrophobing agent may be used per 100 parts by mass of the inorganic oxide particles.

—Method for Preparing Toner Particles—

The method for preparing the toner particles may be a kneading and pulverizing method or a wet granulation method commonly employed. Examples of the wet granulation method include a suspension polymerization method, an emulsion polymerization method, an emulsion polymerization/aggregation method, a soap-free emulsion polymerization method, a nonaqueous dispersion polymerization method, an in-situ polymerization method, an interfacial polymerization method, an emulsion dispersion granulation method, and an aggregation/coalescence method.

When a kneading and pulverizing method is employed to prepare toner particles, for example, a binder resin and, if needed, a colorant and other additives are mixed in a mixer such as a Henschel mixer or a ball mill, and the mixture is melt-kneaded with a thermal kneader such as hot rollers, a kneader, or an extruder so that the resins are compatibilized with each other. The resulting mixture is solidified under cooling, pulverized, and classified to obtain toner particles.

When a wet granulation method is employed to prepare toner particles, for example, the method includes a step of preparing dispersions (resin particle dispersion etc.) by dispersing materials constituting the toner in aqueous media, a step of preparing a raw material dispersion by mixing the dispersions (resin particle dispersion and other various dispersions used as needed), a step of forming aggregated particles in the raw material dispersion, and a step of coalescing the aggregated particles.

The shape factor SF1 of the toner particles obtained by the wet granulation method is, for example, 110 or more and 135 or less. The shape factor SF1 may be determined by analyzing a microscope image or a scanning electron microscope image with an image analyzer, for example. For example, the shape factor SF1 may be determined by capturing an optical microscope image of toner particles scattered on a slide glass through a video camera to a Luzex image analyzer, calculating SF1 for 50 or more toner particles based on the equation below, and averaging the obtained SF1.

$$SF1=(ML^2/A)\times(\pi/4)\times 100$$

where ML represents an absolute maximum length of a particle and A represents a projection area of the particle.

<Properties of Toner Particles>

The volume-average particle size of the toner particles is, for example, in the range of 3.5 μm to 9 μm.

As for the particle size distribution of the toner particles, the toner particles having a particle size 3 μm or less or about 3 μm or less may account for 6% to 25% or about 6% to 25%, or 6% to 16% of the total number of all toner particles on a particle number basis. The toner particles having a particle size 16 μm or more or about 16 μm or more may account for 1.0 vol. % or less or about 1.0 vol. % or less of the total volume of all toner particles on a particle volume basis, for example.

The particle size distribution and volume-average particle size of the toner particles are determined with Coulter multisizer II (produced by Beckman Coulter) and an electrolyte, ISOTON-II (produced by Beckman Coulter). The measured particle size distribution is plotted versus divided particle size ranges (channels) to draw a cumulative distribution for the volume from a small size side. The particle size at which 50% accumulation is given is defined as the volume-average particle size.

<External Additive>

Examples of the external additive externally added to the surfaces of the toner particles include inorganic particles and organic particles.

Examples of the inorganic particles include inorganic oxide particles such as $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$, barium titanate, magnesium titanate, calcium titanate, strontium titanate, silica sand, clay, mica, wollastonite, diatomaceous earth, cerium chloride, red iron oxide, chromium oxide, antimony trioxide, silicon carbide, and silicon nitride. Of these, silica particles and titania particles are particularly preferable as the inorganic particles.

When the inorganic oxide particles are used as an external additive, surfaces of the inorganic oxide particles may be hydrophobized. Hydrophobing the surfaces of the inorganic oxide particles improves the powder flowability of the toner and suppresses the environmental dependency of charging and carrier contamination.

Hydrophobing is conducted, for example, by dipping inorganic oxide particles in a hydrophobing agent, as described above. The hydrophobing agent is not particularly limited. Examples thereof include silane coupling agents, silicone oil, titanate coupling agents, and aluminum coupling agents. These may be used alone or in combination. Among these, silane coupling agents are preferred.

Examples of the silane coupling agents include chlorosilane, alkoxysilane, silazane, and special silylation reagent. Specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The amount of the hydrophobing agent differs depending on the type of the inorganic oxide particles and is not defined, as described above. For example, 5 to 50 parts by mass of the hydrophobing agent may be used per 100 parts by mass of the inorganic oxide particles.

The inorganic particles are used to improve flowability, for example. The primary particle size of the inorganic particles is, for example, 1 nm or more and less than 200 nm. The amount of the inorganic particles added is, for example, 0.01 parts by mass to 20 parts by mass relative to 100 parts by mass of the toner particles.

Examples of the organic particles include polystyrene, polymethyl methacrylate, and polyvinylidene fluoride. For example, the organic particles may be used to improve cleaning property and transfer property.

Examples of the method for adding the external additive to the surfaces of the toner particles include methods of mixing the toner particles with the external additive by using a V blender, a Henschel mixer, or a Lodige mixer.

[Electrostatic Image Developer]

The electrostatic image developer of the exemplary embodiment (also referred to as "developer" hereinafter) is not particularly limited as long as it contains a toner of the exemplary embodiment. The developer may be a one-component developer or a two-component developer. When a two-component developer is used, a toner and a carrier are mixed and used.

The carrier in the two-component developer is not particularly limited. Examples thereof include magnetic metals such as iron, nickel, and cobalt, magnetic oxides such as ferrite and magnetite, a resin-coated carrier including a core and a resin coating layer on the surface of the core, and a magnetic dispersion-type carrier. The carrier may be a resin dispersion-type carrier in which a conductive material or the like is dispersed in a matrix resin.

Examples of the coating resin and matrix resin used in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resin including organosiloxane bonds and its modified products, fluorine resin, polyester, polycarbonate, phenolic resin, and epoxy resin.

Examples of the conductive material include, but are not limited to, metals such as gold, silver, and copper, carbon black, titanium oxide, zinc oxide, barium sulfate, aluminum borate, potassium titanate, and tin oxide.

Examples of the core of the carrier include magnetic metals such as iron, nickel, and cobalt, magnetic oxides such as ferrite and magnetite, and glass beads. The carrier may be a magnetic material if it is to be used in a magnetic brush method.

The volume-average particle size of the core of the carrier is, for example, in the range of 10 μm to 500 μm and may be in the range of 30 μm to 100 μm.

The surface of the core of the carrier may be coated with a resin by using a coating layer-forming solution containing the coating resin and, if needed, various additives dissolved in a solvent. The solvent is not particularly limited and may be adequately selected by considering the type of coating resin used, suitability to coating, etc.

Specific examples of the resin coating method include a dipping method including dipping the core of the carrier in a coating layer-forming solution; a spraying method including spraying a coating layer-forming solution onto the surface of the core of the carrier; a fluid bed method including spraying a coating layer-forming solution while having the core of the carrier floating by using a flowing air; and a kneader coater method including mixing the core of the carrier with a coating layer-forming solution in a kneader coater and removing the solvent.

The mixing ratio (mass ratio) of the toner to the carrier in the two-component developer is adjusted so that the mass of the toner is 0.01 to 0.3 times the mass of the carrier. The mass of the toner may be 0.03 to 0.2 times the mass of the carrier.

The developer of the exemplary embodiment may be used as a developer to be accommodated in a developing device of an image forming apparatus described below. Alternatively, for example, the developer may be used as a replenishing developer used in a so-called trickle development system in which a carrier is also replenished in addition to the toner consumed so that the carrier in the developing device is renewed to suppress changes in charge amount and stabilize the image density.

The mixing ratio (mass ratio) of the toner to the carrier in the two-component developer to be used as such a replenishing developer is adjusted so that the mass of the toner is at least 2 times, 3 times, or 5 times the mass of the carrier.

[Image Forming Apparatus]

An image forming apparatus according to an exemplary embodiment that uses the electrostatic image developing toner of the exemplary embodiment will now be described.

The image forming apparatus of the exemplary embodiment includes an image-carrying member; an electrostatic image-forming unit that forms an electrostatic latent image on a surface of the image-carrying member; a developing unit that develops the electrostatic latent image on the surface of the image-carrying member with the electrostatic image developer of the exemplary embodiment to form a toner image; a transfer unit that transfers the toner image on the surface of the image-carrying member onto a surface of a transfer-receiving member; and a fixing unit that fixes the toner image on the surface of the transfer-receiving member.

The developing unit may include a developer-carrying member that carries the electrostatic developer of the exemplary embodiment. The difference in speed between the surface of the image-carrying member and the surface of the developer-carrying member in terms of the ratio of the rotating speed of the surface of the image-carrying member to the rotating speed of the surface of the developer-carrying member may be, for example, in the range of 1:1.5 or more and 1:5 or less.

The developing unit may include, for example, a developer container for containing a developer; a developer supplying unit for supplying a replenishing developer to the developer container; and a developer discharging unit for discharging at least part of the developer accommodated in the developer container. In other words, the developing unit may employ a trickle development system.

The image forming apparatus of the exemplary embodiment may further include a cleaning unit including a cleaning blade or the like, a charge erasing unit, etc., in addition to the aforementioned units.

A portion that includes the developing unit of the image forming apparatus of the exemplary embodiment may be configured as a cartridge (process cartridge) detachably attachable to the main body of the image forming apparatus.

A non-limiting example of the image forming apparatus of the exemplary embodiment will now be described. Only the relevant components are described below.

FIG. 1 is a schematic diagram showing a color image forming apparatus of a four-drum tandem system. The image forming apparatus shown in FIG. 1 includes first to fourth electrophotographic image forming units 10Y, 10M, 10C, and 10K that respectively output yellow (Y), magenta (M), cyan (C), and black (K) images on the basis of color-separated image data. The image forming units (may be referred to as "units" hereinafter) 10Y, 10M, 10C, and 10K are arranged side-by-side in the horizontal direction at predetermined intervals. The units 10Y, 10M, 10C, and 10K may be configured as a process cartridge detachably attached to the main body of the image forming apparatus.

An intermediate transfer belt 20 that functions as an intermediate transfer member is disposed above the units 10Y, 10M, 10C, and 10K in the drawing. The intermediate transfer belt 20 is stretched over a driving roller 22 and a support roller 24 in contact with the inner surface of the intermediate transfer belt. The driving roller 22 and the support roller 24 are apart from each other in the direction that extends from the left side of the drawing to the right side of the drawing. The intermediate transfer belt is configured to run in the direction from the first unit 10Y to the fourth unit 10K. Force is applied to the support roller 24 with a spring or the like not shown in the drawing in the direction away from the driving roller 22 so that tension is applied to the intermediate transfer belt 20 stretched over the two rollers. An intermediate transfer member cleaning device 30 opposing the driving roller 22 is provided on the image-carrying member-side of the intermediate transfer belt 20.

Yellow, magenta, cyan, and black toners in toner cartridges 8Y, 8M, 8C, and 8K are respectively supplied to developing units 4Y, 4M, 4C, and 4K of the units 10Y, 10M, 10C, and 10K.

Since the first to fourth units 10Y, 10M, 10C, and 10K have identical structures, the first unit 10Y configured to form a yellow image and disposed on the upstream side in the intermediate transfer belt running direction is described as a representative example. The descriptions of the second to fourth units 10M, 10C, and 10K are omitted by giving reference numerals having magenta (M), cyan (C), and black (K) attached to the numerals.

The first unit 10Y includes a photoconductor 1Y serving as an image-carrying member. A charging roll 2Y that charges the surface of the photoconductor 1Y to a predetermined potential, an exposing device 3 that forms an electrostatic latent image by exposing the charged surface with a laser beam 3Y on the basis of a color-separated image signal, a developing device 4Y (developing unit) that develops the electrostatic image by supplying a charged toner to the electrostatic image, a primary transfer roller 5Y that transfers the developed toner image onto the intermediate transfer belt 20, and a photoconductor cleaning device 6Y that removes the toner remaining on the surface of the photoconductor 1Y after the primary transfer are provided around the photoconductor 1Y. The electrostatic latent image forming unit includes the charging roll 2Y and the exposing device 3. The transfer unit includes the primary transfer roller 5Y, the intermediate transfer belt 20, and a secondary transfer roller 26 described below.

The primary transfer roller 5Y is disposed in the inner side of the intermediate transfer belt 20 and opposes the photoconductor 1Y. Bias power supplies (not shown in the drawing) that apply a primary transfer bias are respectively connected to the primary transfer rollers 5Y, 5M, 5C, and 5K. The bias power supplies change the transfer bias applied to the primary transfer rollers by being controlled by a controller not shown in the drawing.

Operation of forming a yellow image by using the first unit 10Y will now be described. Prior to operation, the surface of the photoconductor 1Y is charged to a potential of about −600 V to about −800 V by using the charging roll 2Y.

The photoconductor 1Y is formed by coating a photosensitive layer on an electrically conductive (volume resistivity at 20° C.: $1\times10^{-6}$ Ω·cm or less) substrate. The photosensitive layer usually has a high resistivity (a resistivity of common resin) but when irradiated with the laser beam 3Y, the resistivity of the portion irradiated with the laser beam changes. The laser beam 3Y is output to the charged surface of the photoconductor 1Y through the exposing device 3 in accordance with the yellow image data transmitted from the controller (not shown). The laser beam 3Y hits the photosensitive layer on the surface of the photoconductor 1Y and an electrostatic image of a yellow print pattern is thereby formed on the surface of the photoconductor 1Y.

An electrostatic image is an image formed on the surface of the photoconductor 1Y by charging. A portion of the photosensitive layer irradiated with the laser bean 3Y exhibits a lower resistivity and thus the charges in that portion flow out while charges remain in the rest of the photosensitive layer not irradiated with the laser beam 3Y. Since the electrostatic image is formed by such residual charges, it is a negative latent image.

The electrostatic latent image formed on the photoconductor 1Y is rotated to a predetermined developing position as the photoconductor 1Y is run. The electrostatic latent image on the photoconductor 1Y is visualized (developed) with the developing device 4Y at this developing position.

An electrostatic image developer containing at least a yellow toner and a carrier is accommodated in the developing device 4Y. The yellow toner is frictionally charged as it is stirred in the developing device 4Y and carried on the developer roll (developer-carrying member) by having charges having the same polarity (negative) as the charges on the photoconductor 1Y. As the surface of the photoconductor 1Y pass by the developing device 4Y, the yellow toner electrostatically adheres on the latent image portion on the photoconductor 1Y from which charges are erased and the latent image is thereby developed with the yellow toner.

From the standpoints of development efficiency, image graininess, and tone reproducibility, a bias potential (development bias) formed by superimposing AC components to DC components may be applied to the developer-carrying member. In particular, when the DC voltage Vdc applied to the developer-carrying member is in the range of −300 to −700, the AC voltage peak width Vp-p for the developer-carrying member may be set within the range of 0.5 to 2.0 kV.

The photoconductor 1Y on which the yellow toner image is formed is continuously moved at a predetermined velocity to transport the developed toner image on the photoconductor 1Y to a predetermined primary transfer position.

After the yellow toner image on the photoconductor 1Y is transported to the primary transfer position, a primary transfer bias is applied to the primary transfer roller 5Y. Electrostatic force working from the photoconductor 1Y toward the primary transfer roller 5Y also works on the toner image and the toner image on the photoconductor 1Y is transferred onto the intermediate transfer belt 20. The transfer bias applied at this time has a polarity opposite to that (negative) of the toner, i.e., the polarity of the transfer bias is positive. For example, the transfer bias for the first unit 10Y is controlled to about +10 μA by the controller (not shown).

The toner remaining on the photoconductor 1Y is removed by the cleaning device 6Y and recovered.

The primary transfer bias applied to the primary transfer rollers 5M, 5C, and 5K of the second to fourth units 10M to 10K are also controlled as with the first unit.

The intermediate transfer belt 20 onto which the yellow toner image has been transferred by using the first unit 10Y is transported through the second to fourth units 10M, 10C, and 10K. Toner images of other colors are superimposed on the yellow toner image to form full color image.

The intermediate transfer belt 20 onto which the toner images of four colors are transferred using the first to fourth units then reaches a secondary transfer section constituted by the intermediate transfer belt 20, the support roller 24 in contact with the intermediate transfer belt inner surface, and the secondary transfer roller 26 disposed on the image carrying surface side of the intermediate transfer belt 20. Meanwhile, a recording sheet P (transfer-receiving member) is supplied at a predetermined timing from a supplying mechanism to a space where the secondary transfer roller 26 and the intermediate transfer belt 20 contact each other, and a secondary transfer bias is applied to the support roller 24. The transfer bias applied has the same polarity as the toner (negative). The electrostatic force from the intermediate transfer belt 20 toward the recording sheet P works on the toner images, and the toner images on the intermediate transfer belt 20 are transferred onto the recording sheet P. The secondary transfer bias is determined by the resistance of the second transfer section detected with a resistance detector (not shown) and is controlled by voltage.

Subsequently, the recording sheet P is sent to the contact portion between a pair of fixing rollers in the fixing device 28 (fixing unit). The superimposed toner images are thermally melted and fixed on the recording sheet P.

Examples of the transfer-receiving member onto which the toner images are transferred include regular paper used in electrophotographic system copiers and printers and OHP sheets.

The recording sheet P upon completion of the fixing of the color image is transported toward the discharging unit to terminate a series of color image forming operations.

Although the image forming apparatus has a structure in which toner images are transferred onto the recording sheet P by using the intermediate transfer belt 20, the structure is not limited to this. Alternatively, toner images may be directly transferred from the photoconductor onto the recording sheet.

According to the image forming apparatus of this exemplary embodiment, the toner of the exemplary embodiment is accommodated in the toner cartridge. The developer of the exemplary embodiment containing the toner of the exemplary embodiment and a carrier is accommodated in the developing device.

[Process Cartridge and Toner Cartridge]

Figure 2:
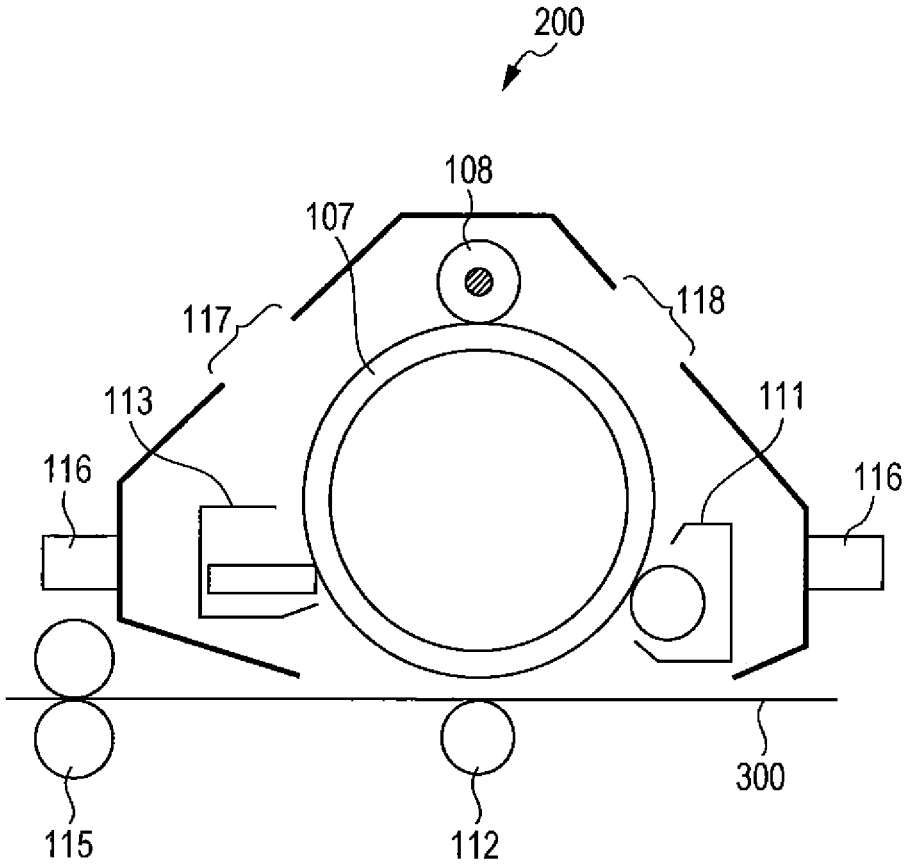
FIG. 2 is a schematic diagram showing an example of a process cartridge according to an exemplary embodiment.

FIG. 2 is schematic diagram showing an exemplary embodiment of a process cartridge accommodating the electrostatic image developer of the exemplary embodiment. A process cartridge 200 includes a developing device 111, a photoconductor 107, a charging roll 108, a photoconductor cleaning device 113, an opening 118 for exposure, and an opening 117 for charge erasing by exposure which are assembled using an assembling rail 116. In FIG. 2, reference numeral 300 denotes a transfer-receiving member.

The process cartridge 200 is detachably attachable to an image forming apparatus main body that includes a transfer device 112, a fixing device 115, and other components (not shown in the drawing), and constitutes part of the image forming apparatus together with the image forming apparatus main body.

The process cartridge 200 shown in FIG. 2 includes the photoconductor 107, the charging roll 108, the developing device 111, the photoconductor cleaning device 113, the opening 118 for exposure, and the opening 117 for charge erasing by exposure. These devices may be selectively combined. The process cartridge of this exemplary embodiment may include the developing device 111 and at least one selected from the photoconductor 107, the charging roll 108, the photoconductor cleaning device 113, the opening 118 for exposure, and the opening 117 for charge erasing by exposure.

A toner cartridge of the exemplary embodiment will now be described. The toner cartridge of the exemplary embodiment is detachably attachable to the image forming apparatus and accommodates a toner supplied to the developing unit in the image forming apparatus. This toner is the aforementioned electrostatic image developing toner of the exemplary embodiment. The toner cartridge of the exemplary embodiment houses at least the toner. Depending on the mechanism of the image forming apparatus, for example, a developer may be accommodated.

According to the image forming apparatus having a detachably attached toner cartridge, the electrostatic image developing toner of the exemplary embodiment may be easily supplied to the developing device by using the toner cartridge containing the electrostatic image developing toner of the exemplary embodiment.

The image forming apparatus shown in FIG. 1 includes detachable toner cartridges 8Y, 8M, 8C, and 8K. The developing devices 4Y, 4M, 4C, and 4K are respectively connected to the toner cartridges of corresponding colors through toner supply ducts not shown in the drawing. When the amount of toner accommodated in the toner cartridge runs low, the toner cartridge is replaced.

In this embodiment, the image-carrying member is a photoconductor but not limited to this. For example, a dielectric recording member may be used.

When an electrophotographic photoconductor is used as the image-carrying member, the charging unit may be, for example, a corotron charger, a contact charger, or the like. The transfer unit may include a corotron charger.

[Image Forming Method]

An image forming method of the exemplary embodiment at least includes a latent image-forming step of forming an electrostatic latent image on a surface of an image-carrying member; a developing step of developing the electrostatic latent image on the surface of the image-carrying member with a developer carried on a developer-carrying member to form a toner image; a transfer step of transferring the toner image on the surface of the image-carrying member onto a surface of a transfer-receiving member; and a fixing step of fixing the toner image on the surface of the transfer-receiving member. A developer that contains the electrostatic image developing toner of the aforementioned exemplary embodiment is used as the developer.

The image forming method may include steps other than the steps described above, if needed. Examples of such steps include a toner removing step of removing the toner remaining on the image-carrying member surface after the transfer step. The latent image forming-step may include a step of charging a surface of the image-carrying member and a step of forming an electrostatic latent image on the charged surface of the image-carrying member. The transfer step may be a step of transferring a toner image from the image-carrying member onto a transfer-receiving member via an intermediate transfer member (intermediate transfer system).

In the developing step, for example, the difference in speed between the surface of the image-carrying member and the surface of the developer-carrying member in terms of the ratio of the rotating speed of the surface of the image-carrying member to the rotating speed of the surface of the developer-carrying member may be, for example, in the range of 1:1.5 or more and 1:5 or less.

EXAMPLES

The exemplary embodiments will now be described in further detail by using Examples and Comparative Examples which do not limit the scope of the exemplary embodiments. Note that "parts" means "parts by mass" and "%" means "mass %" in the description below unless otherwise noted.

<Measurement of Gel Component>

A weighed sample is placed in an Erlenmeyer flask and 20 ml of a special grade toluene left at a room temperature (25° C.) is placed into the flask, followed by stirring for 4 hours at a room temperature (25° C.). Upon completion of dissolution, the sample is kept in a refrigerator (4° C.) overnight (16 hours). The mixture is then placed in a centrifuge tube of a centrifugal separator and centrifugally separated for 20 minutes at a speed of 12,000 turns per hour. The centrifuge tube after centrifugal separation is left standing at room temperature (25° C.) for 1.5 hours. The lid of the centrifugal tube is opened, and 2.5 ml of supernatant is taken with a micropipette and placed in an aluminum dish separately weighed. The toluene component is evaporated by using a hot plate. The aluminum dish is vacuum-dried for 8 hours. The weight of the aluminum dish after vacuum drying is measured and the content of the gel having is calculated by the following equation.

$$\text{Content of gel (\%)}=\{A-[(B-C)\times 8]\}/A\times 100$$

A: mass of sample [g]

B: total mass of toluene solubles and aluminum dish [g]

C: mass of aluminum dish only [g]

<Measurement of Gel Component Having Boron Crosslinked Structure>

Upon completion of the measurement of the gel component described above, only the gel component is taken out by the method below and subjected to acid treatment. Then the gel component having a boron crosslinked structure is measured.

<Synthesis of Resin 1>

To the solution containing the components below, 4 parts by mass of a polymerization initiator (dimethyl 2,2'-azobisisobutyrate (trade name: V601) produced by Wako Pure Chemical Industries) is added. The interior of the flask is thoroughly purged with nitrogen and the mixture is heated in an oil bath under stirring so that the temperature of the system is 70° C. Stirring (polymerization) is continued as is for 5 hours. Then 74 parts by mass of trimethyl borate is added and stirring is continued for one more hour. Then the reaction solution is added to methanol dropwise, unreacted monomers are removed, and the solution is vacuum dried at 40° C. for 16 hours to obtain a resin 1. The resin 1 is analyzed to determine the content of the gel and the content of the gel having a boron crosslinked structure. The results are shown in Table 1.

The infrared absorption, spectrum of the resin is measured. The absorption spectrum changes from 1380 $cm^{-1}$ to 1310 $cm^{-1}$ between before and after addition of trimethyl borate. This confirms formation of a boric acid ester link (boron crosslinked structure). In the examples of forming resins described above, formation of a boric acid ester link (boron crosslinked structure) is confirmed by the same analytic method.

—Components Mixed—

| | |
|---|---|
| Styrene: | 296 parts by mass |
| Glycerin monomethacrylate (BLEMMER GLM produced by NOF Corporation) | 104 parts by mass |
| Acrylic acid | 6 parts by mass |
| Dodecanethiol | 24 parts by mass |
| Carbon tetrabromide | 4 parts by mass |

<Synthesis of Resins 2 to 5>

Resins 2 to 5 are synthesized as with resin 1 except that the amount of the trimethyl borate used (the content of boric acid or the like) is changed as shown in Table 1. The resins obtained are analyzed to measure the gel component and the gel component having a boron crosslinked structure. The results are shown in Table 1. The infrared absorption spectra of these resins excluding the resin 4 (i.e., resins 2, 3, and 5) resin are measured. The absorption spectrum changes from 1380 $cm^{-1}$ to 1310 $cm^{-1}$ between before and after addition of trimethyl borate. This confirms formation of a boric acid ester link (boron crosslinked structure).

<Synthesis of Resin 6>

A resin 6 is synthesized as with the resin 1 except that the amount of styrene is changed to 400 parts by mass and the amount of glycerin monomethacrylate is changed to 0 parts by mass. The resin obtained is analyzed to measure the gel component and the gel component having a boron crosslinked structure. The results are shown in Table 1. The infrared absorption spectrum of this resin is measured but no change in absorption spectrum is observed between before and after addition of trimethyl borate.

<Synthesis of Resin 7>

A resin 7 is synthesized as with the resin 1 except that glycerin monomethacrylate is replaced by trimethylolpropane monoacrylate. The resin obtained is analyzed to measure the gel component and the gel component having a boron crosslinked structure. The results are shown in Table 1. The infrared absorption spectrum of the resin is measured. The absorption spectrum changes from 1380 $cm^{-1}$ to 1310 $cm^{-1}$ between before and after addition of trimethyl borate. This confirms formation of a boric acid ester link (boron crosslinked structure).

<Synthesis of Resin 8>

A resin 8 is synthesized as with the resin 1 except that glycerin monomethacrylate is replaced by 104 parts by mass of glycerol methacrylate. The resin obtained is analyzed to measure the gel component and the gel component having a boron crosslinked structure. The results are shown in Table 1. The infrared absorption spectrum of the resin is measured. The absorption spectrum changes from 1380 $cm^{-1}$ to 1310 $cm^{-1}$ between before and after addition of trimethyl borate. This confirms formation of a boric acid ester link (boron crosslinked structure).

<Synthesis of Resin 9>

A resin 9 is synthesized as with the resin 1 except that 120 parts by mass of tri-i-butyl trimethyl borate is used instead of trimethyl borate. The resin obtained is analyzed to measure the gel component and the gel component having a boron crosslinked structure. The results are shown in Table 1. The infrared absorption spectrum of the resin is measured. The absorption spectrum changes from 1380 $cm^{-1}$ to 1310 $cm^{-1}$ between before and after addition of trimethyl borate. This confirms formation of a boric acid ester link (boron crosslinked structure).

<Synthesis of Resin 10>

A resin 10 is synthesized as with the resin 1 except that 150 parts by mass of a tetramethyl ammonium salt (boron complex) of dicatechol borate is used instead of trimethyl borate. The resin obtained is analyzed to measure the gel component and the gel component having a boron crosslinked structure. The results are shown in Table 1. The infrared absorption spectrum of this resin is measured but no change in absorption spectrum is observed between before and after addition of tetramethyl ammonium salt of dicatechol borate.

TABLE 1

| Resin | Content of boric acid or the like (parts by mass) | Gel component (%) | Gel component having boron crosslinked structure (%) |
|---|---|---|---|
| 1 | 74 | 35 | 15 |
| 2 | 137 | 32 | 12 |
| 3 | 25 | 34 | 14 |
| 4 | 0 | 19 | 0 |
| 5 | 250 | 30 | 10 |
| 6 | 74 | 20 | 0 |
| 7 | 74 | 38 | 22 |
| 8 | 74 | 39 | 20 |
| 9 | 120 | 40 | 21 |
| 10 | 0 | 18 | 0 |

<Toner 1>

| | |
|---|---|
| Resin 1 | 160 parts by mass |
| Cyan pigment (Pigment Blue 15:3 produced by Dainichiseika Color & Chemicals Mfg. Co., Ltd.): | 60 parts |
| Polypropylene wax (Polywax 725 produced by Toyo Petrolite, melting point: 103° C.) | 8.6 parts by mass |

The mixture of the components described above is melted and mixed with a Banbury mixer, cooled, and roughly ground to a particle size of 1 mm or less. The mixture is further ground and classified so that the volume-average particle size is 5.8 mm. As a result, toner particles 1 are obtained.

One hundred parts by mass of toner particles 1 and 0.5 parts by mass of hydrophobic silica (R972 produced by Nippon Aerosil Co., Ltd.) as an external additive are mixed, and external addition is conducted with a stirring mixer to obtain a toner 1.

<Preparation of Toners 2 to 10>

Toners 2 to 10 are prepared as with the toner 1 except that the resins 2 to 10 are used instead of the resin 1.

[Evaluation]

—Preparation of Developer—

To 100 parts by mass of a ferrite carrier having a volume average particle size of 35 μm and being coated with 1% of polymethyl methacrylate resin (Mw: 80,000 produced by Soken Chemical & Engineering Co., Ltd.), 8 parts by mass of the toner is added. The mixture is stirred and mixed for 5 minutes with a ball mill to prepare a developer.

—Evaluation of Transfer Property—

The developer is mounted in DocuCentre-III 3000 (produced by Fuji Xerox Co., Ltd.) (direct transfer system).

A solid patch 5 cm×2 cm in size is developed in an environment having a temperature of 30° C. and humidity of 70%. The developed toner image on the surface of the photoconductor is transferred by utilizing the adhesiveness of a surface of a tape (trade name: Tomei Bishoku, 18 mm in width produced by Sumitomo 3M Limited). This operation is repeated until the toner is no longer visible on the surface of the photoconductor. Then the mass (W1) of the transferred toner is determined.

Next, a toner image developed on the surface of the photoconductor under the same conditions is transferred onto a surface of a paper sheet (J paper produced by Fuji Xerox Office Supply Co., Ltd.). Before fixing, the toner is blown away using air, and the mass (W2) of the transferred image is determined from the difference from the weight of the paper.

The initial transfer efficiency is determined from the equation below where the transfer current is set to 13 μA:

$$\text{transfer efficiency (\%)}=(W2/W1)\times 100$$

Then a 5 cm×2 cm solid patch is formed on 100,000 sheets in an environment having a temperature of 30° C. and a humidity of 70%. The transfer efficiency after operation is determined by the same process as the initial transfer efficiency. A transfer efficiency of 80% or higher is rated as "acceptable".

The observed initial transfer efficiency and transfer efficiency after operation is shown in Table 2.

—Evaluation of Fixability—

The developer is mounted in DocuCentre-III 3000 produced by Fuji Xerox Co., Ltd.) modified so that fixing conditions are adjustable.

An unfixed image is formed on a paper sheet 21 cm in length and 7 cm in width. The image starts from the point 1 cm from a long side serving as a reference and 1 cm from a short side and extends, from that point, 3 cm in a direction parallel to the short side and 4 cm in a direction parallel to the long side. The applied toner amount is 3.1 $mg/cm^2$.

Next, the unfixed image is fixed by increasing the heating temperature from 110° C. to 200° C. in 5° C. increments under a surface pressure of 3.3 $kgf/cm^2$ (0.33 MPa) and a fixing unit contact portion passage time of 220 msec.

The obtained fixed image is folded along a line that is parallel to the long side serving as a reference and 2 cm away from the long side with the toner-image-side facing inward. A stainless steel cylindrical crease measuring jig (5 cm in length, 3.8 cm in outer diameter, 2.9 cm in inner diameter, and 869 g in weight) is rotated on the long side for 3 seconds on the crease line. The width of a portion of the image from which the image is lost is observed with an optical microscope. The width is measured at three points with a microscope gauge and the average is determined. The temperature at which the average is 50 nm or less is assumed to be the minimum fixing temperature. The results are shown in Table 2.

TABLE 2

| Toner | Resin | Volume-average size of toner particles (μm) | Initial transfer efficiency (%) | Transfer efficiency after operation (%) | Evaluation of transfer efficiency | Minimum fixing temperature (° C.) | |
|---|---|---|---|---|---|---|---|
| 1 | 1 | 5.8 | 98 | 85 | Acceptable | 115 | Example |
| 2 | 2 | 6.0 | 96 | 86 | Acceptable | 110 | Example |
| 3 | 3 | 6.1 | 96 | 92 | Acceptable | 110 | Example |
| 4 | 4 | 5.9 | 98 | 78 | Unacceptable | 110 | Comparative Example |
| 5 | 5 | 6.2 | 92 | 80 | Acceptable | 110 | Example |
| 6 | 6 | 5.9 | 96 | 73 | Unacceptable | 125 | Comparative Example |
| 7 | 7 | 5.8 | 98 | 91 | Acceptable | 130 | Example |
| 8 | 8 | 6.1 | 98 | 88 | Acceptable | 130 | Example |
| 9 | 9 | 5.9 | 98 | 90 | Acceptable | 120 | Example |
| 10 | 10 | 5.8 | 91 | 78 | Unacceptable | 110 | Comparative Example |

As shown in the table, the decrease in transfer efficiency caused by operation of the image forming apparatus is suppressed in Examples compared to Comparative Examples. Moreover, the minimum fixing temperature is lower in Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developing toner comprising:

a toner particle including a binder resin containing a resin selected from an acrylic resin, a styrene-acrylic resin, and a styrene-(meth)acrylic acid ester copolymer, wherein the resin has an —O—B—O— crosslinked structure formed from (i) at least one of boric acid or boric acid derivatives and (ii) a functional group contained in the binder resin.

2. The electrostatic image developing toner according to claim 1, wherein the resin is formed by polymerizing an acryl monomer having a hydroxyl group.

3. The electrostatic image developing toner according to claim 2, wherein the acryl monomer having a hydroxyl group accounts for about 5 to about 70 mass % relative to 100 mass % of all monomers constituting the resin.

4. The electrostatic image developing toner according to claim 2, wherein the acryl monomer having a hydroxyl group accounts for about 10 to about 30 mass % relative to 100 mass % of all monomers constituting the resin.

5. The electrostatic image developing toner according to claim 2, wherein the acryl monomer having a hydroxyl group is a monomer selected from the group consisting of glycerol acrylate, glycerol methacrylate, 2-hydroxyethyl acrylate, 2-hydroxyethyl methacrylate, 2-hydroxypropyl acrylate, and 2-hydroxypropyl methacrylate.

6. The electrostatic image developing toner according to claim 1, wherein the amount of the at least one of boric acid and boric acid derivatives is about 0.3 to about 5 parts by mass relative to one part by mass of the resin.

7. The electrostatic image developing toner according to claim 1, further comprising another resin in an amount of about 30 to about 90 mass % relative to the total amount of the resins.

8. The electrostatic image developing toner according to claim 1, wherein, in a toner particle size distribution, toner particles having a particle size of 3 μm or less accounts for about 6% to about 25% of the total number of all toner particles on a particle number basis, and toner particles having a particle size of about 16 μm or more accounts for about 1.0 vol % or less of the total volume of all toner particles on a particle volume basis.

9. An electrostatic image developer comprising:

the electrostatic image developing toner according to claim 1; and a carrier.

10. A process cartridge comprising:

a developing unit housing the electrostatic image developer according to claim 9.

11. An image forming apparatus comprising:

an image-carrying member;

an electrostatic latent image forming device that forms an electrostatic image on a surface of the image-carrying member;

a developing unit that develops the electrostatic latent image on the surface of the image-carrying member with the electrostatic image developer according to claim 9 so as to form a toner image;

a transfer unit that transfers the toner image on the surface of the image-carrying member onto a surface of a transfer-receiving member; and a fixing unit that fixes the toner image on the transfer-receiving member.

12. A toner cartridge comprising:

a cartridge; and the electrostatic image developing toner according to claim 1 accommodated in the cartridge.

13. The toner cartridge according to claim 12, wherein about 70% to about 95% of the volume of the interior of the cartridge is filled with the electrostatic image developing toner.

* * * * *